US007579777B2

(12) United States Patent
Moon et al.

(10) Patent No.: US 7,579,777 B2
(45) Date of Patent: Aug. 25, 2009

(54) PLASMA DISPLAY PANEL PROVIDED WITH AN IMPROVED ELECTRODE

(75) Inventors: Cheol-Hee Moon, Suwon-si (KR); Chang-Seok Rho, Suwon-si (KR)

(73) Assignee: Samsung SDI Co., Ltd., Maeton-dong, Yeongtong-gu, Suwon-si, Gyeonggi-do (KR)

( * ) Notice: Subject to any disclaimer, the term of this patent is extended or adjusted under 35 U.S.C. 154(b) by 601 days.

(21) Appl. No.: 10/977,941

(22) Filed: Nov. 1, 2004

(65) Prior Publication Data

US 2005/0093448 A1 May 5, 2005

(30) Foreign Application Priority Data

Oct. 31, 2003 (KR) ..... 10-2003-0076914

(51) Int. Cl.
*H01J 17/49* (2006.01)

(52) U.S. Cl. ..... 313/585; 313/582

(58) Field of Classification Search ..... None
See application file for complete search history.

(56) References Cited

U.S. PATENT DOCUMENTS

| | | | | |
|---|---|---|---|---|
| 5,225,732 | A * | 7/1993 | Watanabe et al. | 313/582 |
| 5,541,618 | A | 7/1996 | Shinoda | |
| 5,661,500 | A | 8/1997 | Shinoda et al. | |
| 5,663,741 | A * | 9/1997 | Kanazawa | 345/66 |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 5,982,470 | A * | 11/1999 | Nakahara et al. | 349/153 |
| RE37,444 | E | 11/2001 | Kanazawa | |
| 6,545,410 | B1 * | 4/2003 | Wu et al. | 313/582 |
| 6,630,916 | B1 | 10/2003 | Shinoda | |
| 6,707,436 | B2 | 3/2004 | Setoguchi et al. | |

(Continued)

FOREIGN PATENT DOCUMENTS

CN 2146781 Y 11/1993

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Toan Ton
*Assistant Examiner*—Britt Hanley
(74) *Attorney, Agent, or Firm*—Robert E. Bushnell, Esq.

(57) ABSTRACT

A plasma display panel minimizing the presence of electrodes outside the display area. In forming the display electrodes across the display, the electrodes extend to only one of the right or left side of the display area. In forming the address electrodes, the electrodes extend to only one of a top or a bottom side of the display area. By so limiting the amount of electrodes outside the display area, less electrode paste is consumed thus reducing expenses and the size of the glass substrate is reduced thus resulting in a more compact display. All of this can be achieved without reducing the display area of the display.

20 Claims, 3 Drawing Sheets

U.S. PATENT DOCUMENTS

| | | | | |
|---|---|---|---|---|
| 2004/0164930 | A1* | 8/2004 | Hashimoto et al. | 345/60 |
| 2005/0082977 | A1* | 4/2005 | Kwon et al. | 313/583 |

FOREIGN PATENT DOCUMENTS

| | | | |
|---|---|---|---|
| CN | 1279458 | | 1/2001 |
| CN | 1356712 | | 7/2002 |
| CN | 1431675 | | 7/2003 |
| JP | 02-148645 | | 6/1990 |
| JP | 2845183 | | 10/1998 |
| JP | 2917279 | | 4/1999 |
| JP | 2001-043804 | | 2/2001 |
| JP | 2001-325888 | | 11/2001 |
| JP | 2003-045338 | * | 2/2003 |
| JP | 2003-082344 | | 3/2003 |
| KR | 10-2001-0005020 | | 1/2001 |
| KR | 10-2003-0082354 | | 10/2003 |

* cited by examiner

PLASMA DISPLAY PANEL PROVIDED WITH AN IMPROVED ELECTRODE

CLAIM OF PRIORITY

This application makes reference to, incorporates the same herein, and claims all benefits accruing under 35 U.S.C. §119 from an application for PLASMA DISPLAY PANEL PROVIDED WITH AN IMPROVED ELECTRODE earlier filed in the Korean Intellectual Property Office on 31 Oct. 2003 and there duly assigned Ser. No. 2003-76914.

BACKGROUND OF THE INVENTION

1. Field of the Invention

The present invention relates to a plasma display panel having an improved electrode design, and in particular, to a plasma display panel where the presence of electrodes that are outside the display area is minimized.

2. Description of the Related Art

A plasma display panel (referred to as a PDP hereinafter) is typically a display device where ultraviolet rays generated by the discharge of a gas excites phosphors to realize visible images. Two electrodes installed in the discharge cell of the PDP makes plasma discharge under a predetermined voltage applied thereto, and the ultraviolet rays generated by the plasma discharge excite a phosphor layer arranged in a predetermined pattern to form a visible image. The PDP is divided mainly into alternating current (AC), direct current (DC), and hybrid types.

Unfortunately, in a PDP design, electrodes must extend outside the display area to form a connection with a driver and/or a power supply. Excessive electrode presence outside the display area increases the expense in that more electrode paste needs to be consumed and also leads to increases in the size of the device as the glass substrates have to be made significantly larger than the display area. Therefore, what is needed is a design for the electrodes so that the amount of electrodes external to the display area is minimized.

SUMMARY OF THE INVENTION

It is therefore an object of the present invention to provide an improved design for a plasma display panel.

It is also an object of the present invention to provide an improved electrode design for a plasma display panel.

It is further an object of the present invention to provide a design for a PDP that less expensive to make without reducing the size of the display area.

It is further an object of the present invention to provide a design for a PDP that results in a more compact PDP without reducing the size of the display area.

It is still an object of the present invention to provide an electrode design for a plasma display panel that minimizes the amount of electrode material used outside the display area.

It is yet an object of the present invention to provide a design for a plasma display panel that reduces the consumption of electrode paste and reduces the size of the glass substrate itself without compromising on the size of the display area.

These and other objects may be achieved by a plasma display panel that has a first substrate and a second substrate facing the first substrate, address electrodes formed on the first substrate, barrier ribs arranged in a space between the first substrate and the second substrate, forming a plurality of discharge cells, a phosphor layer formed in each of said discharge cells, and display electrodes formed on the second substrate in the direction orthogonal to the address electrodes. The first and the second substrates have a sealing line formed along their edges of where the two substrates overlap each other. The first and the second substrates are joined to each other at the sealing line by frit spread along the sealing line. A display area resides inside the sealing line and a non display area resides outside the sealing line. The address electrode has two ends, one end being inside -the area with the sealing line. The other end of the address electrode extends outside the sealing line and outside the display area. This portion of the address electrode includes a slant part and a terminal reaching outside the area surrounded by the sealing line while extending from the effective part located inside the display area surrounded by the sealing line.

Thus, the area surrounded by the sealing line and the area outside the sealing line where the slant part and the terminal are located are where the electrode paste is applied during the fabrication of the address electrodes. The other end of the address electrodes are located inside the area surrounded by the sealing line, a paste void region is formed outside the area surrounded by the sealing line. Preferably, the paste void area is as wide as 5 to 30 mm.

The display electrode pair includes a scan electrode and a sustain electrode and are formed on the second substrate. The sustain electrode has an effective part which is positioned inside the area surrounded by the sealing line and a short circuit part at one end of the effective part. The short circuit part is a common part connected to all of the sustain electrodes. The paste deposition region for the sustain electrodes is formed in the region where the effective part and the short circuit part are placed. The electrode paste is applied on the area during the fabrication of the sustain electrodes.

The scan electrodes are also formed on the second substrate and have one end inside the sealing line and the other end extending outside the sealing line. The end of the scan electrodes that extend outside the sealing line include a slant part and a terminal part.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
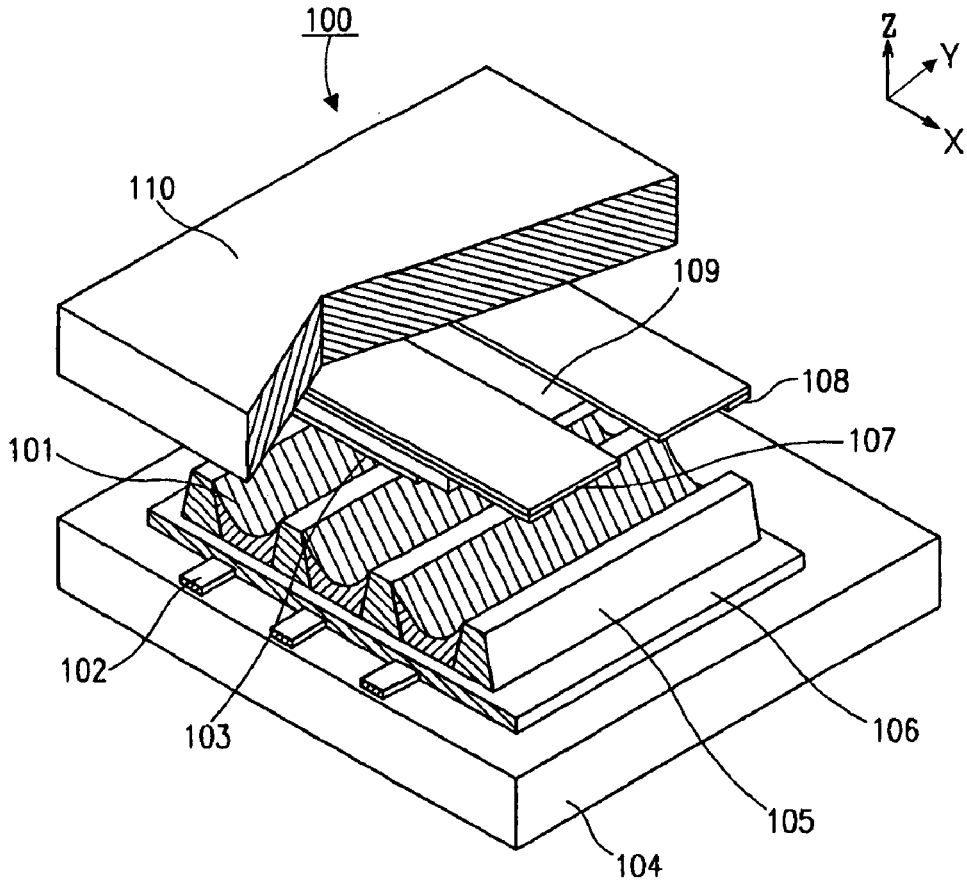
FIG. 1 (PRIOR ART)
FIG. 1 is a perspective view of a plasma display panel, illustrating the discharge cells.

Turning now to the figures, FIG. 1 is a perspective view of discharge cells in an AC plasma display panel 100. According to the drawing, the PDP 100 includes a rear substrate 104, address electrodes 102 that are formed on the rear substrate 104, a dielectric layer 106 formed on the rear substrate 104 covering the address electrodes 102, a plurality of barrier ribs 105 formed on top of the dielectric layer 106 to maintain a discharge space and to prevent crosstalk between discharge cells, and a phosphor layer 101 formed on the surfaces of the barrier ribs 105.

A sustain electrode 107 and a scan electrode 108 are on a bottom side or −z side of the front substrate 110 and together form a pair of display electrodes for each discharge cell while extending in a direction that is perpendicular to the direction of the address electrodes 102 formed on the rear substrate 104. A dielectric layer 109 and a protective layer 103 cover the sustain electrodes 107 and the scan electrodes 108.

In the PDP 100 of FIG. 1, the address electrode 102 and the scan electrode 108 generate an address discharge therebetween upon application of driving voltages to form wall charges on the dielectric layer 109. This causes a discharge in a selected discharge cell by the address discharge, a sustain discharge between the sustain electrode 107 and the scan electrode 108 then occurs by an alternating voltage signal applied alternately to the sustain electrode 107 and the scan electrode 108. Accordingly, a discharge gas filled in the discharge space of the discharge cell is excited and emits ultraviolet radiation in transit, and the ultraviolet radiation excites the phosphor layer in the PDP to emit visible light to realize the images.

The address electrodes of the AC PDP are mainly made of Ag paste. Since an address electrode requires a fine width of as small as 70~80 μm, it is formed mainly by a screen print method and a photolithography method. Also, a lift-off method and a thin film method can be used.

Indium oxide ($In_2O_3$) is used for the material of the scan electrodes and the sustain electrodes. The scan electrodes and the sustain electrodes are called ITO (indium tin oxide) electrodes because a small amount of tin dioxide ($SnO_2$), a chemically stable and hard compound that is added in order to reduce the resistivity of the thin film. In this way, the ITO electrode is made by first forming an ITO thin film by sputtering or electron beam deposition and then patterning an electrode by a photolithography process. The tin dioxide ($SnO_2$) layer is formed by spray method or a CVD (chemical vapor deposition) method, etc. The ITO electrode is essentially transparent to visible light and does not chemically react with or destroy neighboring material. Also, the uniform formation of the thin film can be possible on a large area panel.

In the manufacturing process of the PDP, an electrode paste is spread on a glass substrate to form the address electrodes, the scan electrodes, and the sustain electrodes. During the manufacturing process, however, the electrode paste is spread not only on the display area of the glass where the discharge occurs, but also on areas outside the display area to provide electrical connection thereto. This is very expensive, especially when all of the areas outside the display area where the paste is applied is not absolutely necessary. That causes a waste of material and also causes the size of the device to be even larger and hence be less compact.

Figure 2:
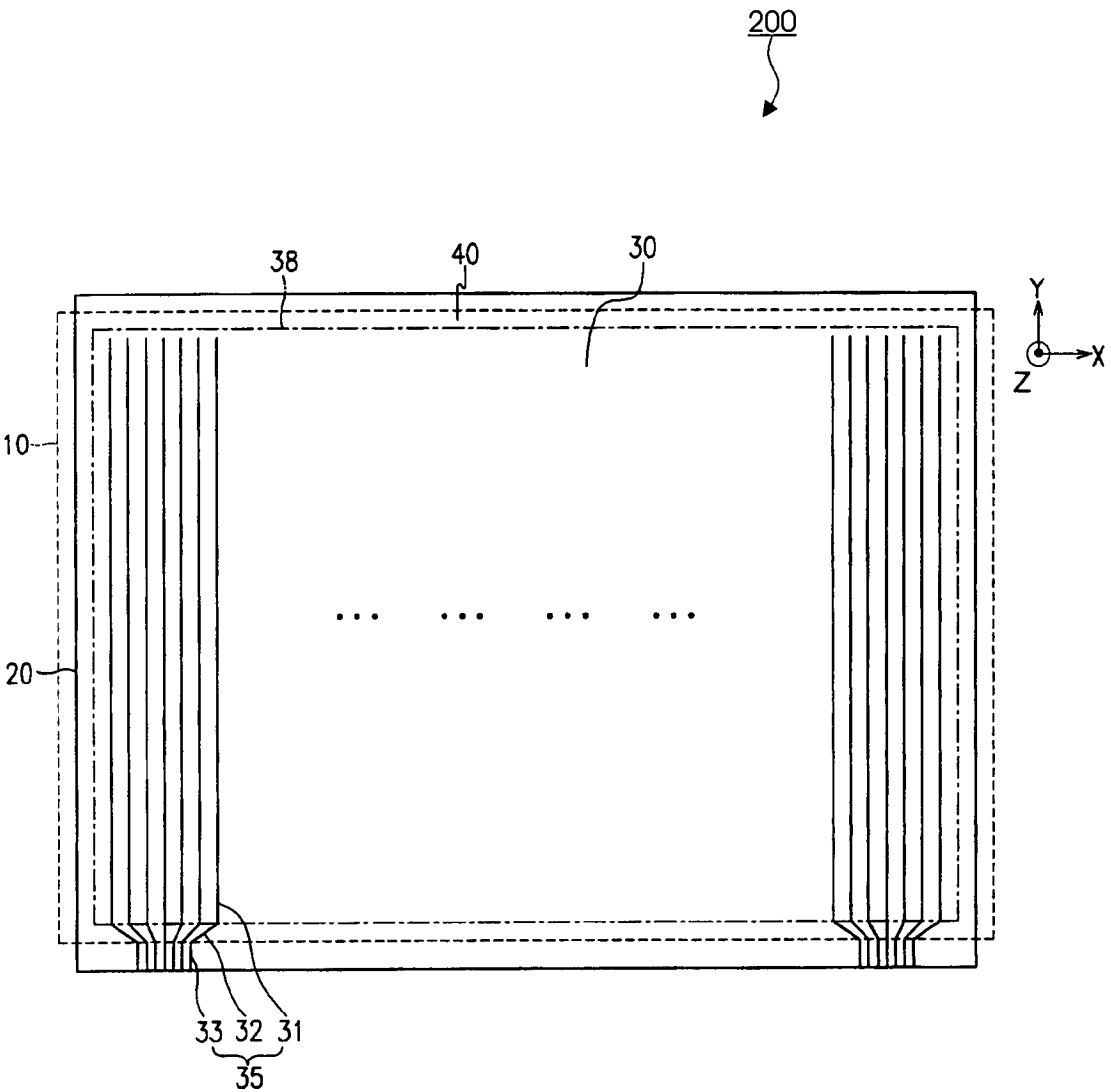
FIG. 2 is a plan view of the address electrodes of the plasma display panel according to the present invention.

Turning now to FIG. 2, FIG. 2 is a plan view of the plasma display panel 200 according to an embodiment of the present invention. FIG. 2 schematically illustrates address electrodes 35 formed on a rear substrate (or first substrate) 20. As a mere example of the present invention, address electrodes 35 are positioned in the single scan mode such that the address electrodes come out at only one edge of the substrate 20. In FIG. 2, the dashed line represents a front substrate (or second substrate) 10 having display electrodes.

The plasma display panel 200 is formed by joining the front substrate 10 to the rear substrate 20 using glass frit. As illustrated in FIG. 2, the front substrate 10 and the rear substrate 20 may have differing sizes. The front substrate 10 is attached to the rear substrate 20 at sealing line 38 located along the edges of the overlapped area. The frit is spread along the sealing line 38. The sealing line 38 usually also separates the display area 30 from non-display areas. In the drawing, the dot-dashed line represents the sealing line 38 where the frit is spread for joining the front substrate 10 to the rear substrate 20. The-area surrounded by the sealing line 38 is a display area 30, and the area outside the sealing line 38 is a non-display area. In FIG. 2, the non-display area is does not have a reference numeral because the non-display area is clearly distinguished from the display area 30.

According to the embodiment of the present invention, the address electrodes 35 are divided into three parts, an address electrode effective part 31 located within the display area 30 on the rear substrate 20, an address electrode slant part 32 located in the non-display area and an address electrode terminal 33 also located in the non-display area but further from display area 30 than the slant part 32. The slant part 32 is between the effective part 31 and the terminal 33 and is connected at one end to the effective part 31 and at the other end to the terminal 33. The address electrode terminal 33 is located outside the overlapped area between the front substrate 10 and the rear substrate 20, being exposed to the outside for connection to an electrical signaling transfer mechanism such as a FPC (Flexible Printed Circuit). Thus, address electrode terminal 33 portion of the address electrodes 35 are located on a part of the rear substrate 20 that is not covered by the front substrate 10.

On the opposite side of the display 200, the end of the address electrodes 35 that is located within sealing line 38 and within display area 30 is covered by front substrate 10. This +y end of the display does not have the slant part 32 or the terminal part 33 as at the −y side of the PDP 200.

During the making of the address electrodes 35, conductive paste is deposited in areas of rear substrate 20 within the display area 30 where the address electrode effective part 31 is formed and in the non display area on the −y side only where the address electrode slant part 32 and the address electrode terminal 33 are formed. On the +y side of the rear substrate outside the sealing line 38 is referred to as the paste void region 40. In the present invention, the paste deposition region for forming the address electrodes is reduced by an area the size of the paste void region 40 because the present invention recognizes that it is not absolutely necessary to use the electrode paste in the paste void region 40. The present invention recognizes that it is not necessary to extend the electrodes into non-display areas at both sides of the display. One of these two opposing sides can be absent from electrodes. Therefore, it is possible to reduce both the consumption of the electrode paste for the address electrodes and the size of the glass substrate by the area equal to the paste void region 40. In addition to these benefits, the integrity of the sealing is improved because of the absence of address electrodes 35 perforating the sealing line on the +y side of the PDP 200.

In summary, PDP 200 of FIG. 2 is an embodiment where the terminals 33 of the address electrodes 35 are formed in a lower end (−y end) of the rear substrate 20 but not at an upper end (+y end) of the PDP 200. Alternately, it is instead possible for the address electrode terminals to be formed in the upper end (+y end) of the rear substrate 20 but not in the lower end (−y end) of the substrate. What is important is that paste need not be deposited and electrodes need not be formed to both ends. The electrodes can extend outside of the display area on one end only and the other end of the electrodes can terminate within, but near the edge of the display area 30.

Figure 3:
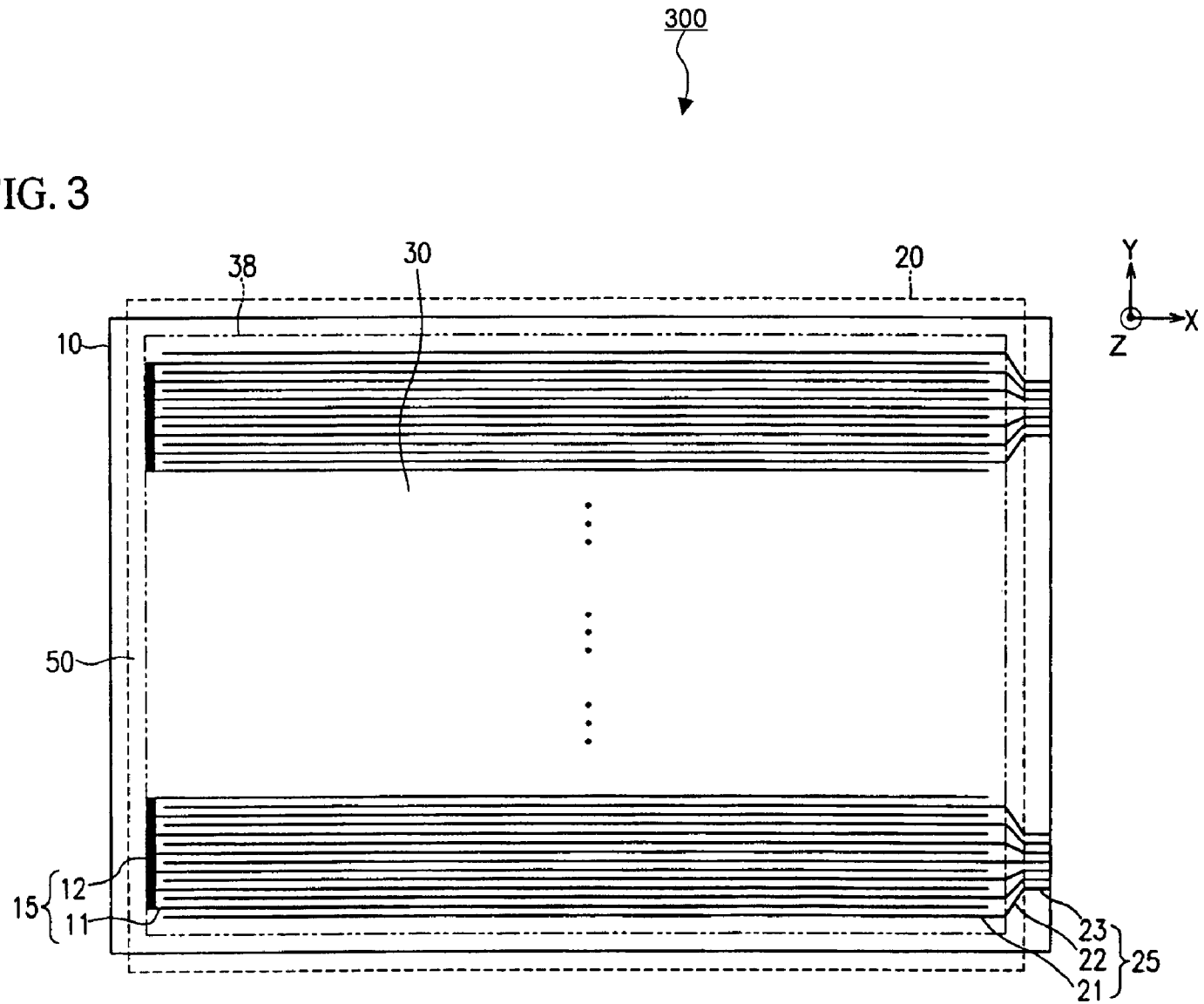
FIG. 3 is a plan view of the display electrodes of the plasma display panel according to the present invention.

Turning now to FIG. 3, FIG. 3 is a plan view of the plasma display panel 300 according to another embodiment of the present invention. In the PDP 300 of FIG. 3, the sustain electrodes 15 and the scan electrodes 25 on the front substrate 10 are illustrated.

As illustrated in FIG. 3, a plurality of display electrodes are formed in the x direction on the front substrate 10 of the plasma display panel 300 of the present invention. The display electrodes include sustain electrodes 15 and scan electrodes 25, preferably formed along the same +x direction and formed in an alternating manner. The sustain electrodes 15 begins at the left (or −x) side and extend to the right (or +x) side along the +x direction. The scan electrode 25 begin at the right (or +x) side and extend to the left side in the −x direction. The sustain electrodes 15 and the scan electrodes 25 can be formed alternately on front substrate 10. The extending directions of the sustain electrodes 15 and the scan electrodes 25 described above are merely examples for the present invention, and therefore these electrodes can instead be formed and extended in directions reversed or opposite to those directions described above.

At the top surface (or +z surface) of the rear substrate 20, located below the front substrate 10, a plurality of address electrodes (not illustrated in FIG. 3) are formed perpendicular to the display electrodes. The regions where the display electrodes cross the address electrodes define the discharge cells for the discharging space, and the discharge cells are located in the display area 30.

A plurality of barrier ribs (not illustrated in FIG. 3) coated with the phosphor layer are arranged in a space between the front substrate 10 and the rear substrate 20 and form the discharge spaces corresponding to the discharge cells defined by the address electrodes 35 and the display electrodes 15, 25. In the plasma display panels 200 and 300, both the sustain electrodes 15 and the scan electrodes 25 are formed on the −z surface of the front substrate 10 facing the rear substrate 20. In FIG. 3, these sustain electrodes 15 and scan electrodes on the backside (or −z side) of the front substrate 10 are illustrated for better understanding.

A driving voltage is applied at the right (or +x) side of the scan electrodes 25, and an address discharge takes place between the scan electrodes 25 and the corresponding address electrodes (not illustrated in FIG. 3). The address discharge starts a substantial discharge process. Under the driving voltage, a sustain discharge follows the address discharge, emitting the visible light to realize the required visible images. The scan electrodes 25 are made up of a scan electrode effective part 21 located in the display area 30 and a scan electrode slant part 22 connected to the scan electrode effective part 21. The scan electrode slant part 22 has a spacing between adjacent electrodes that is smaller than between the effective portions 21 of the scan electrode 25. The scan electrodes 25 also include a scan electrode terminal 23 portion for connection to the electrical signaling transfer device such as the FPC. The spacing between neighboring terminal portions 23 of the scan electrodes is smaller than in the scan electrode slant part 22. Both the slant part 22 and the terminal part 23 of the scan electrodes 25 reside outside the display area 30. Thus, in the formation of the scan electrodes 25 of PDP 300, the electrode paste is applied to the display area 30 and to a portion outside the display area on the right hand side (+x side) but not to the left hand side (or −x side). As in the case of the address electrodes, it is recognized that it is not necessary to extend the scan electrodes 25 into the non display areas on both sides of the display. Extension into the non display area is needed only on one side to connect to a driver. The other ends of the scan electrodes 25 can terminate near the edge but within the display area 30.

According to the embodiment of the present invention illustrated in FIG. 3, the sustain electrodes. 15 have a sustain electrode effective part 11 located inside the display area 30 and a sustain electrode shorted part 12 connected to each of the sustain electrode effective parts 11. A voltage is applied to the sustain electrodes 15 at the sustain electrode shorted part 12 by a separate FPC. FPC may be connected to the sustain electrode shorted part 12 by a fetching terminal which is preferably in a non overlapping region and generally runs in an x direction (not illustrated in FIG. 3.). This voltage is then realized in each of the sustain electrode effective parts 11 connected thereto.

The sustain electrode shorted part 12 is formed at the left end (−x end) of the sustain electrode effective part 11 and is connected by a single line to each of the left ends (−x ends) of the sustain electrode effective parts 11. Since the voltage applied to all the sustain electrodes 15 is the same, it is possible to form this single short-circuit line 12 connected to all of the sustain electrode effective parts 11. Therefore, the display area 30 having the sustain electrode effective parts 11 and the sustain electrode shorted part 12 receives paste deposition for forming the sustain electrodes 15, and the area outside the sealing line 38 to the left (or −x side) of display area 30 is a paste void region 50.

By such a design for the display electrodes, the paste deposition region is reduced by the area of the paste void region 50 due to the lack of need to deposit electrode paste in the paste void region 50 since no electrodes reside in paste void region 50. Accordingly, it is possible to reduce both the consumption of the electrode paste for the sustain electrodes 15 and the size of the glass substrate by the area of the paste void region 50.

It is to be appreciated that ITO is generally used for the display electrodes. ITO material is used generally for the transparent portion of the display electrodes. This ITO film is made by sputtering or ion plating and then is patterned with photolithography processes. Because the transparent ITO portions of the display electrodes have a high resistivity, the display electrodes also include a more conductive bus electrode portion along an edge of the transparent ITO portion. These highly conductive bus portions can be made using a silver paste. This silver bus electrode portion of the display electrodes is formed by a printing method by photolithography using a photo-sensitive silver paste and frit glass. Thus, the display electrode that is located on the front substrate can include both ITO and bus metal electrode at the same time.

As described above, in the plasma display panels according to the present invention, by minimizing the formation of the unnecessary electrodes outside the display area 30, the material cost for forming the electrodes can be reduced by approximately 6% and the glass size can also be reduced while keeping the size of the display area 30 constant.

It is also to be appreciated that the embodiment of FIG. 2 can be combined with the embodiment of FIG. 3 so that tow of the four edges of the display can be absent of electrode paste and absent of electrodes. Thus, tow of the four sides are for electrical connections and the other two of the four sides are paste void regions.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A plasma display panel, comprising:

a first substrate facing a second substrate;

a plurality of address electrodes arranged on the first substrate;

a plurality of barrier ribs arranged in a space between the first substrate and the second substrate and defining a plurality of discharge cells;

a plurality of phosphor layers arranged in the plurality of discharge cells, respectively;

a plurality of display electrodes arranged on the second substrate and extending in a direction crossing ones of the plurality of address electrodes, wherein a sealing line is arranged near a periphery of where the first and the second substrates overlap each other, each of the plurality of address electrodes extends from a first side of said plasma display panel to a second and opposite side of said plasma display panel, and said each of the plurality of address electrodes extends through said sealing line to an exterior of said sealing line at only one of said first side and said second side of said plasma display panel, each of the plurality of display electrodes comprising a scan electrode and a sustain electrode, each sustain electrode comprising an effective portion arranged within an area surrounded by the sealing line and a short circuit portion arranged at one end of the effective portion, with the short circuit portion being electrically connected to and in common with the effective portion of each sustain electrode, and the short circuit portion residing entirely within the image area.

2. The plasma display panel of claim 1, wherein each of the plurality of address electrodes terminates within an area surrounded by said sealing line and does not penetrate to an outside of said sealing line at an other of said first side and said second side of said plasma display panel.

3. The plasma display panel of claim 1, comprised of the first substrate having a paste deposition region located in an area surrounded by the sealing line, and the paste deposition region also extending to an area outside the sealing line only at said one of said first side and said second side of the plasma display panel.

4. The plasma display panel of claim 3, comprised of the first substrate having a paste void region arranged outside the area surrounded by the sealing line at an other of said first side and said second side of said plasma display panel, and the paste void region being absent of electrode material.

5. The plasma display panel of claim 4, wherein a width of the paste void region is between 5 and 30 mm.

6. The plasma display panel of claim 1, further comprising frit arranged along the sealing line and attaching the first substrate to the second substrate.

7. The plasma display panel of claim 1, wherein each of the plurality of display electrodes comprises a scan electrode and a sustain electrode, each sustain electrode comprises an effective portion arranged within an area surrounded by the sealing line and a short circuit portion arranged at one end of the effective portion, with the short circuit portion being electrically connected to and in common with the effective portion of each sustain electrode.

8. The plasma display panel of claim 7, wherein the second substrate comprises a paste deposition region for the sustain electrodes, with the paste deposition region for the sustain electrodes being coextensive with the effective portion and the short circuit portion of each sustain electrode.

9. The plasma display panel of claim 7, comprised of each scan electrode extending from a third side to a fourth and opposite side of the plasma display panel, and each scan electrode residing within the sealing line and extending through the sealing line to an outside of the sealing line at only one of the third side and fourth side of the plasma display panel.

10. The plasma display panel of claim 7, comprised of each scan electrode extending from a third side to a fourth and opposite side of the plasma display panel, with a region at said fourth side of said plasma display panel and exterior to said sealing line being absent of any scan electrodes.

11. A plasma display panel, comprising:

a first substrate facing a second substrate;

a plurality of address electrodes arranged on the first substrate;

a plurality of barrier ribs arranged in a space between the first substrate and the second substrate and defining a plurality of discharge cells;

a plurality of phosphor layers arranged in the plurality of discharge cells, respectively;

a sealing line contacting both of the first and second substrates for sealing the first and second substrate, and being arranged near a periphery of where the first and the second substrates overlap each other; and a plurality of display electrodes arranged on the second substrate and extending in a direction crossing ones of the plurality of address electrodes, with the plasma display panel having an image area surrounded by the sealing line and a non display area outside the image area, the non display area being at the edges of the plasma display panel, each of the plurality of address electrodes extending from a first end to a second and opposite end, and the first end of each of the plurality of address electrodes being within the image area, each of the plurality of display electrodes comprising a scan electrode and a sustain electrode, each sustain electrode comprising an effective portion arranged within an area surrounded by the sealing line and a short circuit portion arranged at one end of the effective portion, with the short circuit portion being electrically connected to and in common with the effective portion of each sustain electrode, and the short circuit portion residing entirely within the image area.

12. The plasma display panel of claim 11, wherein a paste void area is arranged between the first end of ones of the plurality of address electrodes and an edge of the plasma display panel closest to the first end of ones of the plurality of address electrodes, with said paste void area being absent of electrode material.

13. The plasma display panel of claim 11, comprised of the second end of each of the plurality of address electrodes being within the non display area, and a distance between adjacent ones of the plurality of address electrodes within the non display area being smaller than a distance between adjacent ones of the plurality of address electrodes within the image area.

14. The plasma display panel of claim 11, comprised of each of the plurality of address electrodes comprising an effective portion, a slant portion and a terminal portion, the slant portion being between the terminal portion and the effective portion, the slant portion and the terminal portion at the second end of each of the plurality of address electrodes residing within the non display area, and a spacing between adjacent ones of the plurality of address electrodes becoming progressively smaller from the effective portions to the terminal portions.

15. The plasma display panel of claim 11, comprised of each of the plurality of display electrodes extending from a first end to a second and opposite end, and the first end of each of the plurality of display electrodes being within the image area.

16. A plasma display panel, comprising:

a first substrate facing a second substrate;

a plurality of address electrodes arranged on the first substrate;

a plurality of barrier ribs arranged in a space between the first substrate and the second substrate and defining a plurality of discharge cells;

a plurality ofphosphor layers arranged in the plurality of discharge cells, respectively;

a sealing line contacting both of the first and second substrates for sealing the first and second substrate, and being arranged near a periphery of where the first and the second substrates overlap each other; and a plurality of display electrodes arranged on the second substrate and extending in a direction crossing ones of the plurality of address electrodes, with the plasma display panel having an image area surrounded by the sealing line and a non display area outside the image area, the non display area being at the edges of the plasma display panel, each of the plurality of display electrodes comprising a scan electrode and a sustain electrode, each sustain electrode comprising an effective portion arranged within the image area and a short circuit portion arranged at one end of the effective portion, and the short circuit portion being electrically connected to and in common with the effective portion of each sustain electrode, with the short circuit portion of each sustain electrode residing entirely within the image area.

17. The plasma display panel of claim 16, comprised of the scan electrodes and the sustain electrodes being arranged in a alternating manner.

18. The plasma display panel of claim 16, comprised of each scan electrode having a first end and a second and opposite end, the first end residing within the image area, and the first end of each scan electrode being arranged near the short circuit portion of the sustain electrodes.

19. The plasma display panel of claim 16, comprised of each scan electrode having a first end and a second and opposite end, the second end extending through the sealing line and into the non display area, and the second end being connected to drivers.

20. A method for fabricating a plasma display panel, comprising:

forming a sealing line on a major surface of a first substrate to be sealed with a second substrate, with the sealing line defining a rectangular image area surrounded by the sealing line and a non display area outside the sealing line;

depositing an electrode paste on the first substrate inside the image area and only on a first side of the non display area, to form a plurality of address electrodes;

depositing an electrode paste on the second substrate inside the image area and only on a second side of the non display area, to form a plurality of display electrodes, with each of the plurality of display electrodes comprising a scan electrode and a sustain electrode, each sustain electrode comprising an effective portion arranged within the image area and a short circuit portion arranged at one end of the effective portion, and the short circuit portion being electrically connected to and in common with the effective portion of each sustain electrode, with the short circuit portion residing entirely within the image area; and spreading frit along the sealing line to sealing the first substrate with a second substrate.

* * * * *